United States Patent [19]

Itoh et al.

[11] Patent Number: 4,662,338

[45] Date of Patent: May 5, 1987

[54] FUEL INJECTION NOZZLE

[75] Inventors: Katsuoki Itoh, Leonberg; Iwan Komaroff, Regensburg, both of Fed. Rep. of Germany

[73] Assignee: Robert Bosch GmbH, Stuttgart, Fed. Rep. of Germany

[21] Appl. No.: 347,815

[22] Filed: Feb. 11, 1982

[30] Foreign Application Priority Data

Feb. 17, 1981 [DE] Fed. Rep. of Germany ..... 3105686

[51] Int. Cl.[4] ..... F02M 63/04

[52] U.S. Cl. ..... 123/467; 123/446; 123/458; 239/453

[58] Field of Search ..... 123/446, 458, 457, 462–467, 123/472; 239/453, 456, 459, 533.2–533.12

[56] References Cited

U.S. PATENT DOCUMENTS

| | | | |
|---|---|---|---|
| 1,658,026 | 2/1928 | Blanding | 123/462 |
| 3,319,613 | 5/1967 | Begley et al. | 123/458 |
| 3,575,145 | 4/1971 | Steiger | 123/458 |
| 3,628,024 | 12/1971 | Clemochowski | 123/458 |
| 3,718,283 | 2/1973 | Fenne | 239/533.4 |
| 3,753,426 | 8/1973 | Lilley | 123/457 |
| 4,104,992 | 8/1978 | Fricker | 123/446 |
| 4,300,873 | 11/1981 | Mowbray et al. | 123/467 |
| 4,341,351 | 7/1982 | Deluca | 239/453 |
| 4,350,301 | 9/1982 | Erwin et al. | 23/453 |
| 4,363,446 | 12/1982 | Jaggle et al. | 123/468 |

*Primary Examiner*—Willis R. Wolfe, Jr.
*Attorney, Agent, or Firm*—Edwin E. Greigg

[57] ABSTRACT

A fuel injection nozzle for internal combustion engines which has a valve needle loaded in the closing direction and is radially guided and supported in an axially displaceable manner within a nozzle body. The movement of the valve needle is effected in the opening and closing directions in a selectively variable manner, a spring-loaded supplementary mass which performs a dual function being disposed in the nozzle interior. In the opening direction of the valve needle, the supplementary mass is displaced along with the valve needle, while in the closing direction the two elements are separated. The supplementary mass influences the movement of the valve needle both inertially, as the result of its mass, and by effecting a speed-dependent damping, as the result of the positive displacement of a fluid from damping chambers, the whole being adapted to a constant or variable throttle disposed in the fuel inlet conduit.

11 Claims, 4 Drawing Figures

FUEL INJECTION NOZZLE

BACKGROUND OF THE INVENTION

The invention is based on a fuel injection nozzle for an internal combustion engine. In a fuel injection nozzle of this kind, which in this instance opens inward, it is known to cause a valve needle tang to move in the opening direction until it stops at a spring-loaded supplementary mass, so that a shock-absorbing braking effect is attained during the opening movement. The supplementary mass displaces fuel from a damping chamber via a calibrated flowthrough opening, and the fuel flows back into the damping chamber through the same calibrated opening in the interval between opening strokes of the valve needle. (British Patent No. 720,011). The supplementary mass which damps the valve needle movement is disposed in an axial elongation of the valve needle, so that the resultant injection nozzle is quite long; it is also disadvantageous that the generally smaller masses and available damping chambers do not permit a precise adaptation and adjustment of the manner in which the valve needle movement takes its course. Intervening in order to prevent disadvantageous recoiling in the case of such valve needles with a high closing speed is not possible.

In a further known fuel injection nozzle for internal combustion engines (German Auslegeschrift No. 20 52 311) the valve needle does cooperate with a spring-loaded annular piston, but not for the purpose of damping needle movement; instead, the intention is to form a reservoir of variable volume, so that a substantial increase in fuel pressure at the moment of injection is avoided. The annular piston acts as a buffer, counter to the force of its helical spring, and it is initially deflected so as to increase the pressure chamber volume of the supplied fluid quantity.

In order to attain adaptation and optimizing both in injection valves opening in the flow direction (so-called A-valves) and in valves opening counter to the flow direction, it is desirable to influence the opening and closing movements in a precisely intended manner, because these movements, in cooperation with the coupled outflow cross section of the injection ports, shape the course of injection. There is a general trend toward miniaturization, which exists even in conventional, inwardly opening injection nozzles (I-nozzles); in addition, however, particularly small nozzle needle injection tangs (in A-valves) are required for providing the stream-type fuel preparation also demanded at the present time. This, in turn, results in valve neeldes of very small diameter, compared with conventional nozzles. Such small valve needles, however, enable an adaptation of the inherent frequency and the optimal damping only in narrow operating ranges; as a result, an adaptation of these injection nozzles over the complete performance graph of the engine cannot be attained. For instance, phase displacements may occur as a consequence of oscillations of the valve needle between the discharge cross section of the valve and the pressure inside the valve, which at times of low pressures in the valve chamber cause combustion gases to flow out of the engine combustion chamber into the interior of the valve, possibly depositing soot at the functionally important metering cross section and eventually charring it. The course of injection in particular, and accordingly the course of combustion, are unfavorably influenced by these oscillations. The result is rough engine operation, which produces unfavorable toxic and particulate emissions. Valve charring causes the angle of the fuel stream to widen, and there is increased combustion noise, which results in an impairment in terms of mixture formation, fuel consumption and smoke emissions.

There is accordingly a need for a fuel injection nozzle which is small in struture and those opening and closing movements can be variably and intentionally influenced.

OBJECT AND SUMMARY OF THE INVENTION

The fuel injection nozzle according to the invention has the advantage that by combining a fixed or variable inlet throttle with a supplementary mass enabling a flexible variation of the rigidity of the hydraulic spring and of the speed-dependent hydraulic damping, it is possible to introduce additional functional members for exerting intentional influence on the valve needle movement during the injection process, so that optimal adaptation to a particular engine performance graph can be attained.

With the invention, both the opening movement and the closing movement of the valve needle can be influenced in an intended manner, and the very small needle diameter now attained enables a particularly favorable stream-type fuel preparation. The movement of the valve needle in the opening direction can be slowed down or damped severely in order to optimize the course of combustion, while in the closing direction movement continues unimpeded. The invention increases the adaptability of fuel injection nozzles in general, and particularly of those with small valve needle diameters, which are becoming increasing more common as miniaturization progresses.

As a result of the characteristics and provisions disclosed, advantageous modifications of and improvements to the fuel injection nozzle are possible. One advantageous feature is the attainment of speed-dependent damping by means of disposing the piston (which represents the supplementary mass) such that it has adaptable amounts of play while the bearing of the piston remains generally concentric with respect to the valve needle.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
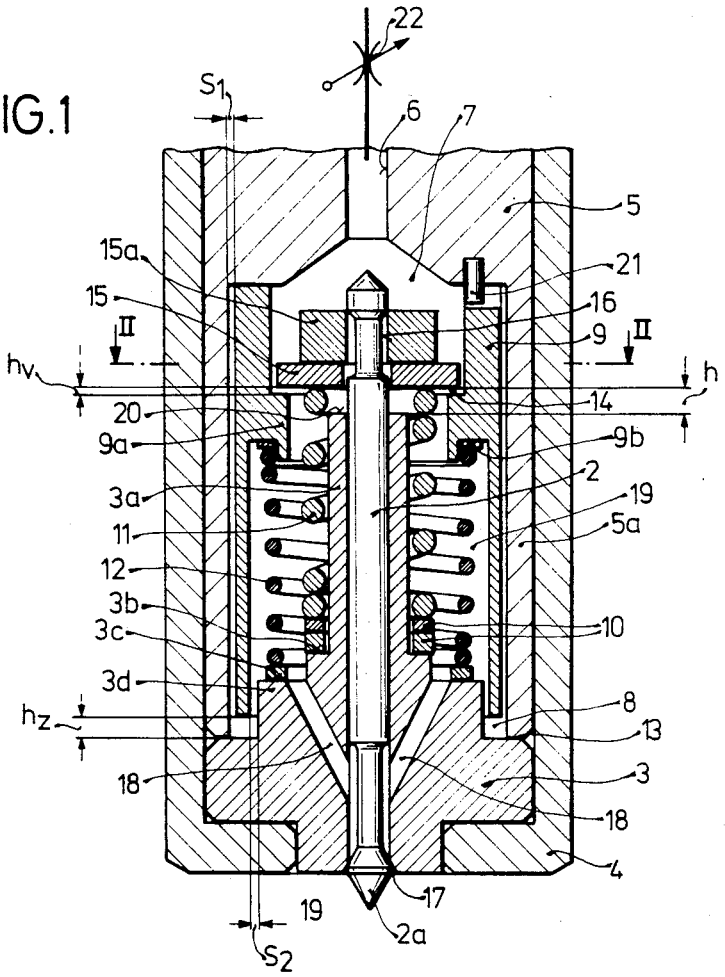
FIG. 1 is a cross sectional view taken through a first form of an embodiment of an outwardly opening fuel injection nozzle (A-valve) according to the invention.
Figure 4:
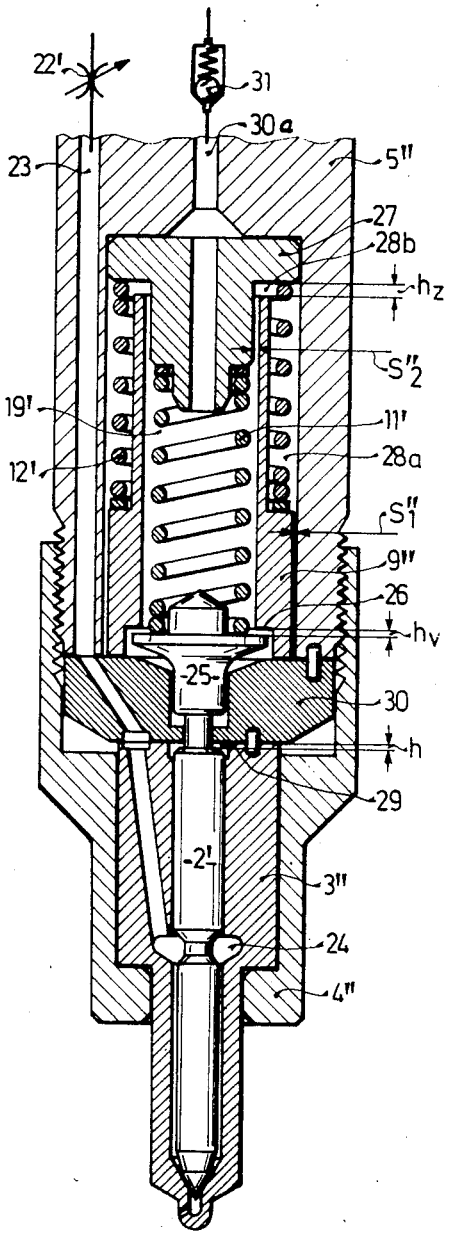
FIG. 4 shows a cross sectional view of a second form of embodiment revealing an inwardly opening fuel injection nozzle (I-valve) according to the invention.

Throughout the specification, identical elements are provided with identical reference numerals; however, because of the difference in the fundamental concept of the exemplary embodiments of FIGS. 1 and 4, the reference numerals for FIG. 4 are provided with a prime.

The injection nozzle shown in FIG. 1, which opens outwardly—that is, in the flow direction—includes a valve needle 2 which is supported in a nozzle body 3 such that it is radially guided and axially displaceable. The nozzle body 3 is clamped by means of a sleeve nut 4 to a connector body 5 (the rest of which, toward the top, is not shown), which may also be part of the nozzle holder. Fuel which is under pressure proceeds via an inlet bore 6 in the connector body 5 into a pressure chamber 7, which is defined by the connector body 5, the nozzle body 3 and the valve needle 2.

In the illustrated exemplary embodiment, the invididual structural elements are disposed concentrically with one another and are fitted inside one another in telescoped fashion. The connector body 5 has an outer annular wall 5*a* which define a sleeve that extends downwardly and at 13, this annular wall 5*a* is adapted to meet an outer annular surface of the nozzle body 3 and on the inside supports a supplementary mass 9, which has a substantially cylindrical shape. The shape of the nozzle body 3 is stepped such that it is narrower at the top, so that beginning at an inner, high annular wall 3*a* in which the valve needle 2 is closely guided radially, further annular faces 3*b* and 3*c* are provided which are disposed outward therefrom at different levels. With the interposition of spacer discs 10, these annular faces 3*b* and 3*c* provide support surfaces for the valve needle closing spring 11 and an initial-stressing spring 12 for the supplementary mass 9.

An annular chamber 8 is formed between a first stepped annular shoulder 3*d* and the downwardly extended outer annular wall 5*a* of the connector body 5. This annular chamber 8 acts as a damping chamber for the movement of the supplementary mass 9 and protrudes into the supplementary mass with the lower end of its cylindrical annular wall. On the inside, the supplementary mass 9, which takes the general form of a hollow damping piston, has a protruding annular flange 9*a*, which at the bottom provides an annular stop face 9*b* for the pre-stressing spring 12 at the top provides a stop 14. Resting on this stop 14 is a stroke-stop disc 15 of the valve needle, which is seated and held together with a supplementary block 15*a* in a restriction 16 of the valve needle 2. Since on the inside the stroke stop disc 15 engages the closing spring 11 for the valve needle, the valve needle is pre-stressed at the top in its closed position, so that a valve cone 2*a* formed by the valve needle is pressed against its valve seat 17 provided by the nozzle body 3. Lower inlet conduits 18 which are provided in the nozzle body 3 discharge from the spring chamber 19 into an annular chamber embodied by a restriction at the lower portion of the valve needle 2, between the valve needle and the surrounding nozzle body 3. From this annular chamber, the fuel delivered under pressue via the upper inlet conduit 6 is ejected in the desired stream conformation when the valve needle 2 lifts from its seat.

Figure 2:
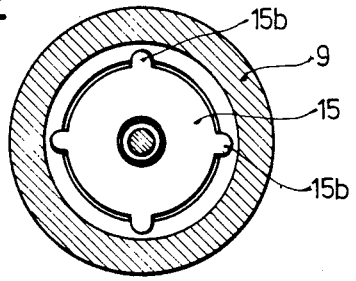
FIG. 2 is a section on line II—II of FIG. 1.

As shown in FIG. 1, the stroke-stop disc may be at a predetermined distance $h_v$ from the stop 14, embodied by the inner annular flange of the supplementary mass; the total stroke h of the valve needle is determined by the distance between the stroke-stop disc 15 and the upper annular face 20 of the inner annular wall 3*a* of the valve body, this face 20 representing a mechanism end stop. In addition, the outer cylinder wall of the supplementary mass 9 in the annular wall 5*a* of the connector body 5 has a predetermined spacing or play $S_1$, and in the inner, upwardly extended shoulder 3*d* of the nozzle body 3 it is guided with a play $S_2$. For the sake of preventing the supplementary mass 9 from twisting or having a tendency to rotate when it is in the form of a piston, a fixation pin 21 is also provided. It may be seen from the cross-sectional view of FIG. 1 that the stroke-stop disc 15 has an arbitrary, irregular shape on its periphery, so that it may rest, for instance, with only four protrusions 15*b*, shown in FIG. 2*a* and distributed uniformly about the circumference, on the stop 14; the fuel can thus flow freely from the pressure chamber 7 into the spring chamber 19 and from there, through the lower inlet conduits, to the area intended for ejection.

OPERATION

The fuel injection nozzle illustrated in FIG. 1 thus functions in the following manner. The throttle, located in the inlet bore 6 and indicated schematicaly there by reference numeral 22, may be either a fixed or an adjustable throttle; in the case of the fixed throttle, its cross section is adapted to the full-load operational point. If an adjustable throttle is provided, then it is adaptable to many operational points and can be adjusted with the aid of appropriate control means in the operational performance graph. This adjustment may be effected by mechanical, hydraulic or electrical means, for example, as a function of the rpm and of the injected fuel quantity (load) of the engine. The task of the throttle is generally to increase the inherent frequency and to damp the valve. The installed location of the throttle 22 may also be important because of the valve volume coupled thereby to the pressure line. It is efficacious to optimize the location of installation for a particular application by experimental means.

The spring-loaded supplementary mass 9 located in the interior of the fuel injection nozzle has a twofold function. First, it increases the valve mass in the opening direction, so that it is possible to optimize the instant when it becomes effective in the opening movement of the valve needle 2 by varying the "pre-stroke" distance $h_v$. If it is intended that the valve needle 2 function without any pre-stroke instead, then the distance $h_v$ can also be reduced to zero. In order to prevent undesirable overoscillation of the supplementary mass 9 during the opening movement, the supplementary mass has its own stroke stop $h_z$, embodied in the exemplary embodiment of FIG. 1 by the opposing annular faces of the supplementary mass 9 and the nozzle body 3. In order for the valve needle to be capable of executing it complete needle stroke h, the stroke stop $h_z$ for the supplementary mass 9 is preferably larger in size than the valve needle stroke h.

In its closing movement, the valve needle 2 is separated from the supplementary mass 9 and executes a rapid closing movement under the influence of its closing spring 11. The more-sluggish supplementary mass 9 is guided back into its initial position by its own restoring or prestressing spring 12. It thus acts as a movable stroke stop for the valve needle and prevents any opening movements of the valve needle which might occur. By appropriately dimensioning the pre-stroke distance $h_v$, it is possible to limit recoiling which could occur in valve needles developed for a high closing speed.

The second function of the supplementary mass 9 has to do with attaining a speed-dependent damping, because in its described form of embodiment the supplementary mass acts as a piston within the damping chamber 8 described above, having the predetermined amount of play $S_1$ and $S_2$. When the supplementary mass 9 is carried along by the valve needle 2 as it moves in its opening direction, the supplementary mass, functioning as a piston, positively displaces the fluid located in the damping chamber 8, so that the fluid must escape along the areas of play $S_1$ and $S_2$.

Figure 3:
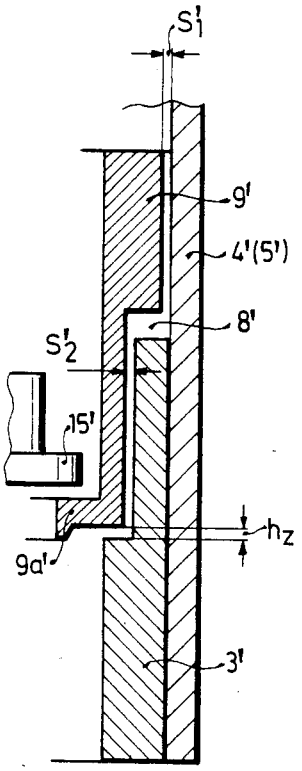
FIG. 3 shows a variant in the embodiment of the damping chamber, seen in partial section.

It will be understood that the basic principle of the present invention lends itself to many modifications and structural alterations; thus FIG. 3, by way of example, shows a stepped outer shape of the supplementary mass 9', forming a first damping chamber at 8' and a second, smaller damping chamber at 8''. The restoring spring 12' for the supplementary mass 9' acts upon a lower stop shoulder formed by an inwardly protruding annular flange 9a'. At the top, the annular flange 9a' simultaneously forms the stop for the stroke-stop disc 15' of the valve needle 2 (not shown). The amounts of play between the supplementary mass 9' and the connector body 5' or the sleeve nut 4' and the nozzle body 3', which are adaptable to given dynamic-hydraulic conditions, are indicated as $S_{1'}$ and $S_{2'}$.

By combining the throttle 22 and a supplementary mass which can be varied by size, shape, manner of installation and degree of coupling to the valve needle 2, the adaptability of the A-valves shown in FIGS. 1 and 3 is increased. Since similar problems in optimizing the needle damping also occur with injection nozzles which open inwardly, the invention can also be applied to I-valves, as shown by FIG. 4. The fixed or variable throttle 22' is disposed in this case in the inlet conduit 23 for the fuel, which is under pressure. The inlet conduit discharges into a pressure chamber 24 formed between the valve needle 2' and the nozzle body 3'', in which the valve needle 2' is radially guided and supported in an axially displaceable manner. Simultaneously with an inner shoulder 26 of the supplementary mass 9'', the spring support plate 25, which is engaged by the closing spring 11' for the valve needle, provides the pre-stroke distance $h_v$ which the valve needle must overcome during its opening movement before the supplementary mass is carried along with it; in a specialized case, this distance $h_v$ could also become zero. The supplementary mass is guided in the spring chamber 19' with a first play $S_{1''}$ relative to the nozzle holder 5'' and with a second play $S_{2''}$ relative to an upper spring support plate 27, on which not only the closing spring 11' of the valve needle but also the restoring spring 12' of the supplementary mass 9'' is supported. Damping chambers for the damping-piston-like movement of the supplementary mass 9'' are formed at 28a and 28b, this damping chamber simultaneously determining the stroke stop $h_z$ of the supplementary mass 9''. The valve needle stroke h is produced at 29 in the form of the distance between a valve needle shoulder and the washer 30 by way of which the nozzle body 3'' is held tightly on the nozzle holder 5'' by the sleeve nut 4''. Since the mode of operation of the exemplary embodiment shown in FIG. 4, is identical to that of the injection valve having variably predeterminable opening and closing movements described above, it does not require further discussion at this point. The principal difference in thus embodiment lies solely in the fact that the supplementary mass 9'' in the spring chamber 19' operates counter to a leakage oil volume, which escapes via a leakage oil conduit 30a having a check valve 31.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines having a spring loaded needle supported in an axially displaceable manner within a nozzle body and further including a spring-loaded supplementary damping mass which influences at least the needle opening movement, characterized in that a fuel throttle means is disposed in a fuel inlet line to said injection nozzle and that said supplementary damping mass is physically displaced from said spring loaded needle and cooperates with a damping chamber exposed to fuel flow, said supplementary damping mass being guided with a predetermined radial play to enable passage therethrough of fuel whereby valve needle supplementary damping is subjected to the inertia of said damping mass as well as being dependent on speed.

2. A fuel injection nozzle as defined by claim 1, characterized in that said nozzle body further includes a guide means for said valve needle, and a support for a valve needle closing spring and a restoring spring, said closing spring and restoring spring being encompassed by said supplementary damping mass and said nozzle holder.

3. A fuel injection nozzle as defined by claim 1, characterized in that said nozzle needle further includes a strokestop disc, and said supplementary damping mass has an inner annular flange at a predetermined spaced distance from said strokestop disc.

4. A fuel injection nozzle as defined by claim 1, characterized in that said nozzle body further includes concentric annular faces which lie in plural horizontal planes and thereby provide support for said valve needle closing spring and said restoring spring of said supplementary damping mass.

5. A fuel injection nozzle as defined by claim 1, characterized in that said fuel throttle means is mechanically adjustable as a function of rpm and of fuel injection quantity.

6. A fuel injection nozzle as defined by claim 1, characterized in tht said fuel throttle means is hydraulically adjustable as a function of rpm and of fuel injection quantity.

7. A fuel injection nozzle as defined by claim 1, characterized in that said fuel throttle means is electrically adjustable as a function of rpm and of fuel injection quantity.

8. A fuel injection nozzle as defined by claim 1, characterized in that said valve needle opens outwardly and said supplementary damping mass comprises an annular wall concentric with said valve needle, said annular wall further being spaced apart axially from said nozzle body and a nozzle holder to form an annular damping chamber having an axial damping chamber distance, said supplementary damping mass, said nozzle body and said nozzle holder further being spaced at predetermined radial distances to provide said radial play.

9. A fuel injection nozzle as defined by claim 8, characterized in that said axial damping-chamber distance of said supplementary damping mass simultaneously forms a stroke stop therefore.

10. A fuel injection nozzle as defined in claim 1, characterized in that said valve needle opens inwardly and said supplementary damping mass is disposed axially of said valve needle and forms annular damping chambers with said nozzle holder and an annular end chamber having an upper spring support plate.

11. A fuel injection nozzle as defined by claim 10, characterized in that a restoring spring is disposed in said damping chamber formed by said supplementary damping mass together with said nozzle holder.

* * * * *